US007537558B2

(12) United States Patent
Vono et al.

(10) Patent No.: US 7,537,558 B2
(45) Date of Patent: May 26, 2009

(54) BOOKLETMAKER NIP-IDLER ASSIST CREASING DEVICE

(75) Inventors: Sandro Vono, Thornhill (CA); Raymond Matthew Ruthenberg, Toronto (CA); Joao Carlos Morais, Brampton (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/768,650

(22) Filed: Jun. 26, 2007

(65) Prior Publication Data

US 2009/0005229 A1 Jan. 1, 2009

(51) Int. Cl.
*B31F 1/10* (2006.01)

(52) U.S. Cl. ..... 493/443; 493/442; 493/445; 493/454; 493/455; 270/37; 270/58.11

(58) Field of Classification Search ..... 493/442–446, 493/454–455, 405, 419, 449; 270/37, 58.11
See application file for complete search history.

(56) References Cited

U.S. PATENT DOCUMENTS 4,338,088 A * 7/1982 Buss et al. ..... 493/445
4,840,609 A * 6/1989 Jones et al. ..... 493/28
4,909,779 A * 3/1990 Schaffron ..... 493/235
5,169,376 A * 12/1992 Ries et al. ..... 493/445
5,272,511 A 12/1993 Conrad et al.
5,377,569 A 1/1995 Richards et al.
5,445,592 A 8/1995 Richards
5,738,620 A * 4/1998 Ebner et al. ..... 493/445
6,568,668 B1 * 5/2003 Wakabayashi et al. ... 270/58.11
6,730,010 B2 * 5/2004 Yamakawa et al. ..... 493/267
6,773,386 B1 * 8/2004 Staniszewski ..... 493/416
6,799,759 B1 10/2004 McNamara et al.
6,817,605 B1 * 11/2004 Bohn ..... 270/37
6,939,283 B2 9/2005 Sparano et al.
6,981,938 B2 1/2006 Ruthenberg et al.
7,293,766 B2 * 11/2007 Ruthenberg et al. ..... 270/37
2004/0188911 A1 9/2004 McNamara et al.
2005/0037906 A1 2/2005 Sparano et al.
2005/0037908 A1 2/2005 Ruthenberg et al.
2007/0013118 A1 1/2007 Ruthenberg et al.

* cited by examiner

*Primary Examiner*—Christopher Harmon
(74) *Attorney, Agent, or Firm*—Oliff & Berridge, PLC

(57) ABSTRACT

An assembly to crease a paper set in a booklet maker is provided. A booklet is formed in a booklet marker when a crease blade strikes the middle of the stack and pushes it toward a set of nipped crease rolls. The assembly engages spring-loaded idlers against the crease rolls after the crease blade initiates the buckle of the stack and prior to creasing. The spring loaded idlers apply a drive force to the stack that assists the formation of the crease. With the assistance of this extra drive force, the crease blade tip can be stopped in time to avoid jamming while reducing the chance of getting a cover, or more sheets tearing off the booklet. This design is compact in size and therefore may also be retrofitted into existing designs.

16 Claims, 10 Drawing Sheets

BOOKLETMAKER NIP-IDLER ASSIST CREASING DEVICE

BACKGROUND

The exemplary embodiments generally relate to media handling and finishing for machines, such as printers and copiers for producing documents, booklets and other materials and specifically relate to booklet makers.

Folding or creasing a stack of several sheets of paper in the middle of the paper is part of forming a booklet. The sheets may be stapled at the fold line, resulting in a stapled booklet or bound in some other manner. A booklet is formed in a booklet maker, where a crease blade strikes the middle of the stack and pushes the stack towards a pair of nipped (upper and lower) crease rolls, which are typically made of an elastomer material. The blade stops at a fixed distance before the centerline of crease rolls. The crease blade does not travel through the crease rolls. The distance between the tip of the crease blade and the centerline of the crease rolls is important to the function of the booklet maker. If the crease blade is pushed too far into the crease rolls, sheet wrinkling or blade/roll jamming may occur. If the crease blade stops too far away from the crease rolls and the sheets are slippery, the sheet(s) closest to the crease rolls may be pulled off the stack of paper. Sheets may be slippery for many reasons, such as the media type, waxy toners, color ink, area coverage, and the like. The sheet closest to the crease rolls that is pulled off the stack is often the cover of the booklet. If the booklet is stapled, the cover sheet (and possibly more sheets) may be torn off the stapled portion, resulting in a paper jam and or a damaged document.

This problem has previously been tackled by allowing the crease blade to travel through the crease rolls, by protruding segments past the blade tip and segmenting the crease rolls. The blade segments travel between and through the roll segments, thereby pushing the sheets through the rolls. Because of the segmented characteristics of the blade and rolls, the roll never pinches the blade and sheet wrinkling or blade or roll jamming cannot occur. In addition, as the blade pushes and forces the sheets through the rolls, the cover sheet does not tear or pull off the stack of paper. This is generally accomplished with two sets of crease rolls. The first is the segmented set, which does not provide a continuous and crisp fold, and its function is to acquire the stack and make the initial crease without allowing the outer sheet(s) to separate from the rest of the book. The second set of rolls is continuous and is used to create the final crisp fold along the entire edge of the book.

SUMMARY

Exemplary embodiments include aspects of a booklet maker with spring-loaded assist idlers, placed above and below a blade. The upper and lower portion of the stack is clamped against the elastomer crease rolls when the blade travels towards the rolls. The crease blade initiates the buckle in the stack before the spring-loaded assist idlers clamp the stack. When clamped, the idlers apply equal nip forces to the top and bottom halves of the stack. This generates a drive force on the stack to assist feeding the stack into the crease roll nip. The stack, including the cover sheet, moves through the crease roll nip, thereby preventing the cover sheet from tearing or pulling off the stack of paper. In addition to preventing the cover of the booklet from pulling or tearing off, exemplary embodiments have an advantage of producing a crisp fold with a single set of continuous crease rolls. A single roll pair design also allows for larger diameter rolls, which is also a factor in preventing sheet separation in the book. Exemplary embodiments may be used and packaged within the volume of existing machines, allowing for easy upgrade or retrofit.

One aspect is a device for forming a fold in one or more sheets that extend along a first direction. The device includes a blade and one or more movable members. The blade moves in a second direction that intersects the first direction to contact the sheets at a first position. The member moves to contact the sheets at least at a second position, which is different from the first position, to move a section of the sheets in the second direction. The device may include a pair of rolls forming a nip. The nip is disposed along a path of the section of the sheets movable in the second direction. The fold in the sheets is creased by the nip after the sheets pass through the nip. The nip and a portion of the sheets at the first position may both be disposed along the path in the second direction. The device may include a second movable member to contact the sheets at least at a third position, which is different from the first position and the second position, to move the section of the sheets in the second direction. The first and second movable members may move the sheets by applying forces pressing the sheets against the pair of rolls. A buckle may be created in the sheets by contact of the blade with the sheets. A binder may bind the sheets. Another aspect is a finisher module for machines, such as printers and copiers for producing documents, booklets and other materials.

Another aspect is a method for forming a fold in one or more sheet that extends along a first direction. A blade moves in a second direction that intersects the first direction to contact the sheets at a first position. One or more movable members move to contact the sheets at least at a second position, which is different from the first position, to move a section of the sheets in the second direction. A nip may be formed with a pair of rolls along a path of the section of the sheets movable in the second direction. The fold may be creased in the sheets as they pass through the nip. The nip and a portion of the sheets at the first position may both be disposed along the path in the second direction. A second movable member may move to contact the sheets at least at a third position, which is different from the first position and the second position, to move the section of the sheets in the second direction. The pair of rolls may be rotated and the sheets may be moved by the movable members to apply forces pressing the sheets against the rotating pair of rolls. A buckle may be created in the sheets. A fold may be formed in the sheets and bound at the fold.

Yet another aspect is a system forming a fold in at least one sheet that extends in a first direction. The system includes means for contacting the at least one sheet at a first position by movement in a second direction that intersects the first direction; and means for moving a section of the at least one sheet in the second direction by contacting the at least one sheet at a second position, which is different from the first position.

DETAILED DESCRIPTION OF EMBODIMENTS

Figure 1A:
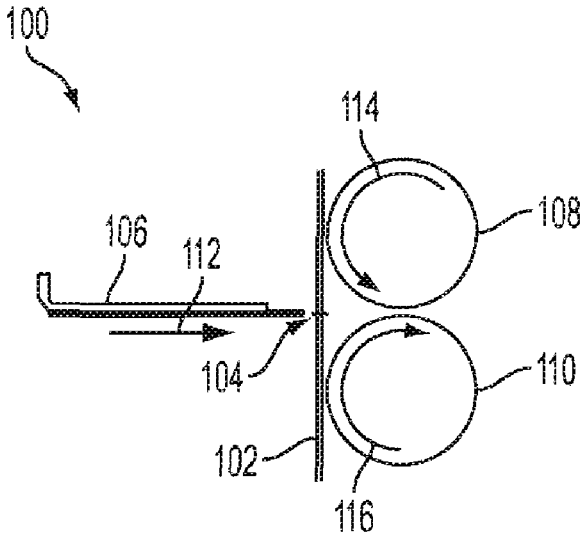
FIG. 1A RELATED ART
FIGS. 1A, 1B, 1C and 1D illustrate a current problem of a subassembly for a booklet maker in the related art.
Figure 1B:
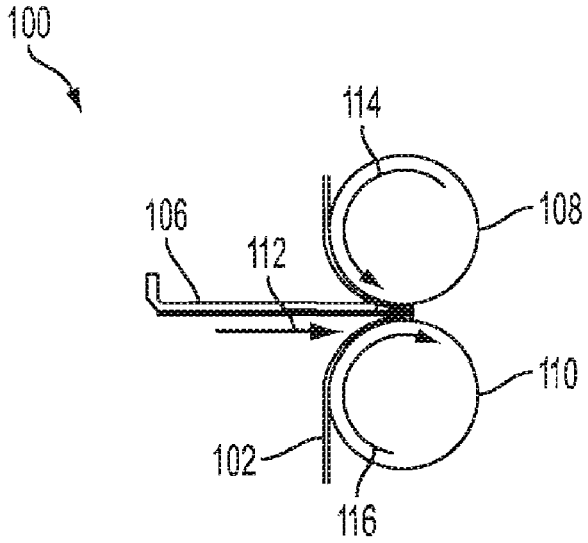
FIG. 1B RELATED ART

FIGS. 1A-1D illustrate a current problem of a subassembly 100 for a booklet maker in the related art. FIG. 1A shows a stack of sheets 102 being stapled 104 and a crease blade 106 advancing toward a pair of crease rolls 108, 110. The crease rolls 108, 110 are typically elastomer and spring-loaded or nipped in order to squeeze or exert a certain pressure or force on the sheets passing between them. The direction of the movement of the blade 106 is indicated by an arrow 1112. The upper crease roll 108 moves in a counterclockwise direction, while the lower crease roll 110 moves clockwise, as indicated by arrows 114, 116. FIG. 1B illustrates the crease blade 106 having traveled towards the crease rolls 108,100, pushing the sheets 102 into the crease rolls 108,100 (i.e., initiating the buckle in the sheets 102). The booklet is compiled as the sheets are lined up and pushed in the center with the action of the blade 106 and then folded (or creased) between the crease rolls 108, 110. In this manner, the crease blade 106 initiates the crease and then the crease rolls 108, 100 finish off the crease to make a crisp fold so that the booklet remains folded. In some cases, the booklet may continue to another finisher module.

Figure 1C:
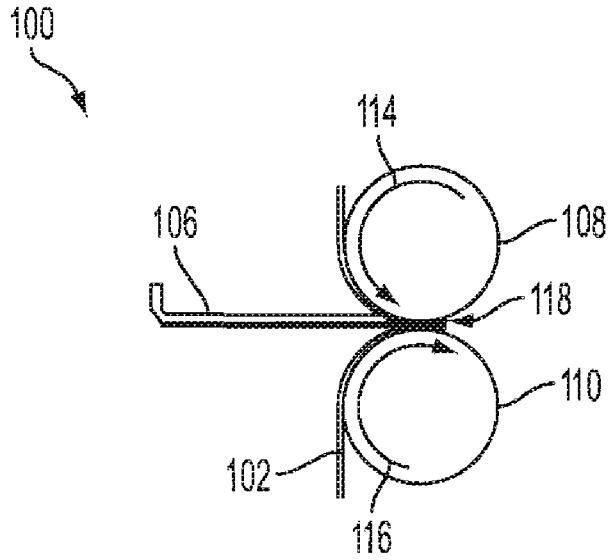
FIG. 1C RELATED ART
Figure 1D:
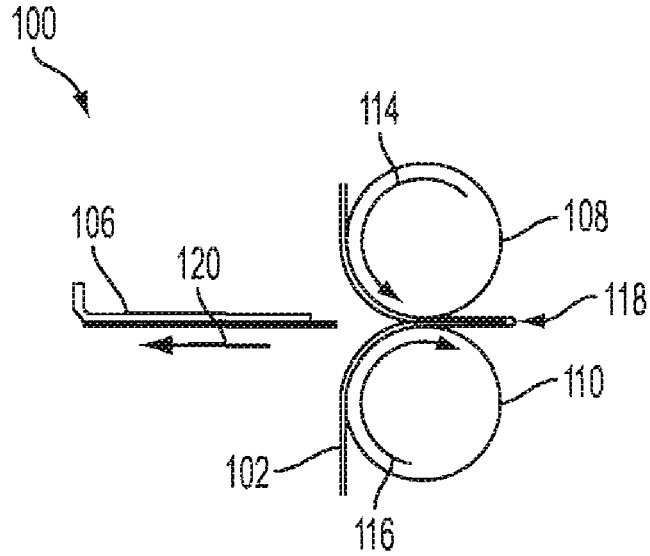
FIG. 1D RELATED ART

FIG. 1C illustrates the crease blade 106 having stopped moving. Due to the slipperiness (i.e., low coefficient of function) between the sheets 102, the crease rolls 108, 110 are pulling or tearing the cover sheet 118 off the stack 102. As illustrated in FIG. 1D, the crease blade 106 has retracted as shown by arrow 120. The crease rolls 108, 110 continue to pull or tear the cover sheet 118 off the stack 102. The coefficient of friction between the sheets 102 may be affected by many different factors, such as a toner or ink causing a waxy surface or glossy paper. Under such low friction conditions, the crease rolls 108, 100 may not be able to hold onto the body of the stack of sheets, causing one or more inside sheets to become misaligned (e.g., falling out or being left behind) or the cover (i.e., outside or first) sheet 118 to be torn. The blade 106 cannot travel through the rolls to secure the inside sheets because it may become stuck or jammed between the crease rolls 108, 110. Even if the blade 106 did not become stuck or jammed between the crease rolls 108, 110, the blade 106 might pull the sheets 102 between the crease rolls 108, 110 back outside the crease rolls 108, 110 as it retracted.

Figure 2A:
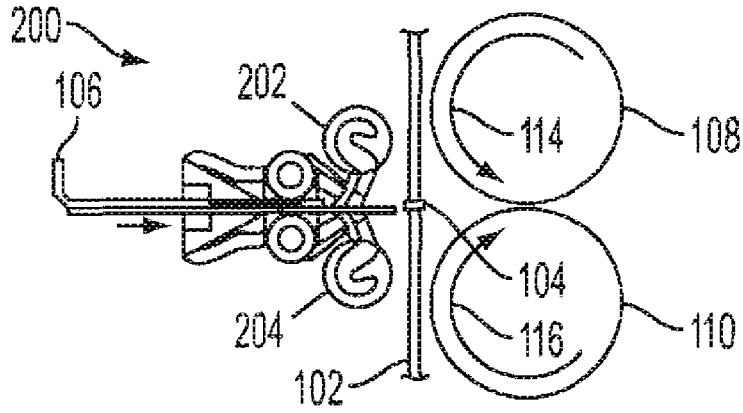
FIGS. 2A, 2B, 2C and 2D illustrate an exemplary embodiment of a subassembly for a booklet maker.
Figure 2B:
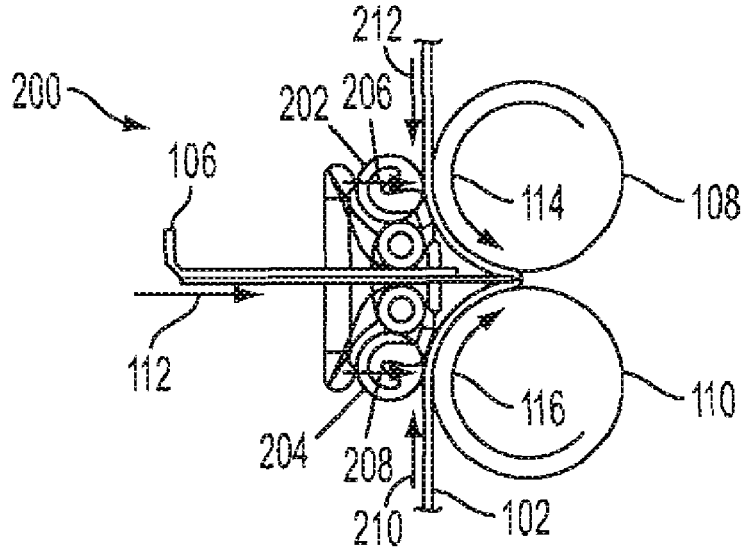

FIGS. 2A, 2B, 2C and 2D illustrate an exemplary embodiment 200 of a subassembly for a booklet maker that eliminates the torn cover problem by assisting the sheets 102 as they enter into the crease rolls 108, 110. This exemplary embodiment 200 in FIG. 2A includes the crease blade 106 and a spring-loaded assist idler assembly 202, 204 advancing toward the crease rolls 108, 110. FIG. 2B shows the crease blade 106 pushing the sheets 102 into the crease rolls 108, 110 to initiate the buckle of the sheets 102. Both the upper 202 and lower 204 spring-loaded assist idlers clamp the sheets 102 against the elastomer crease rolls 108, 110 and provide equal nip forces (indicated by arrows 206, 208) to the upper and lower half of the stack 102 against the crease rolls 108, 110. These nip forces create drive forces (indicated by arrows 210, 212) to assist the sheets in entering the crease rolls by helping to transport them toward the crease rollers 108, 110.

Figure 2C:
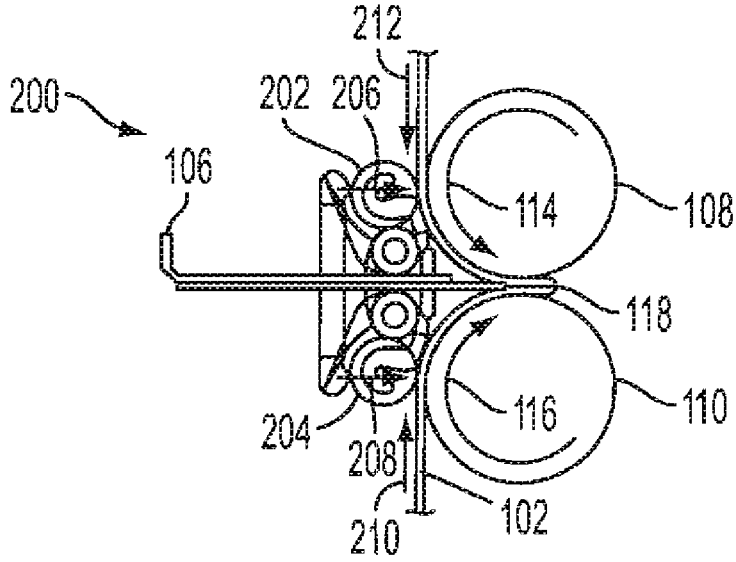

FIG. 2C illustrates the crease blade 106 having stopped moving and the spring-loaded assist idlers 202, 204 continuing to clamp or nip the stack 102. The spring-loaded assist idlers 202, 204 continue to provide a drive force to the upper and lower half of the stack 102 against the crease rolls 108, 110 to assist the entire stack 102 in entering into the crease rolls 108, 110. The pressure to be exerted by the spring-loaded assist idlers 202, 204 increases with the number of sheets in the stack 102. This continues until the fold lines of all of the sheets 102 have passed the crease rolls 108, 110, preventing the cover sheet 118 from pulling or tearing off the stack 102. Once the booklet has been creased in FIG. 2D and the fold line is past the nip (i.e., the nip created between the crease rolls 108, 110), then the blade 106 retracts (as shown by arrow 120). The crease rolls 108, 110 continue to transport the booklet out of the booklet maker without pulling or tearing off the cover sheet 118 from the stack 102. In other embodiments, the spring-loaded assist idlers 202, 204 may be replaced by any other spring-loaded part(s) or mechanism(s) capable of applying the needed force(s) to assist the stack 102 in entering into the crease rolls 108, 100.

As the spring-loaded assist idlers of subassembly 200 move from the left to the right (FIG. 2A to 2B) and squeeze against the crease rolls 108, 100, the sheets 102 are pinched and, then, the rotation of the crease rolls 108, 100 (i.e., upper 108 counterclockwise 114 and lower 110 clockwise 116) drives the sheets 102. As the spring-loaded assist idlers move from the left to the right (FIG. 2A to 2B) with the motion of the blade 106, the springs (not shown) extend (or elongate) while the idlers rotate and greater force is applied so that the nip force increases to a point where the sheets are driven into the middle of the crease rolls 108, 110 to create the crease (i.e., fold). In one embodiment, the nip force (arrows 206, 208) of the spring-loaded assist idlers 202, 204 is determined, calculated or chosen to provide proper driving force (arrows 210, 212) to successfully crease sheets 102 without the sheet(s) closest to the crease rolls being pulled off the stack.

One exemplary embodiment is a subassembly 200 to crease a paper set in a booklet maker. This exemplary embodiment includes an upper 202 and lower 204 spring-loaded assist idler placed respectively above and below the crease blade 106. The subassembly engages the spring-loaded assist idlers 202, 204 against the crease rolls 108, 110 after the crease blade 106 initiates the buckle of the stack 102 and prior to creasing. The spring-loaded assist idlers 202, 204 apply nip forces to a top and bottom portion of the stack 102 and drive forces on the stack 102 to assist feeding the stack 102 into the crease roll nip (i.e., the nip formed by the crease rolls 108, 110). The drive forces on the stack 102 assists in the formation of the crease as well. With the assist of this extra drive force, the crease blade tip 106 can be stopped in time to avoid jamming while reducing the chance of getting a cover tear off. One embodiment uses only a single set of crease rolls (i.e., the single pair of crease rolls 108, 110) to produce a substantially crisp fold using, as opposed to the prior art with two sets of crease rolls (see FIG. 5). One embodiment includes a single roll pair with a diameter large enough to help prevent cover sheet separation or tearing in the resulting booklet. One embodiment is compact in size so that it may be retrofitted into existing booklet makers.

Figure 2D:
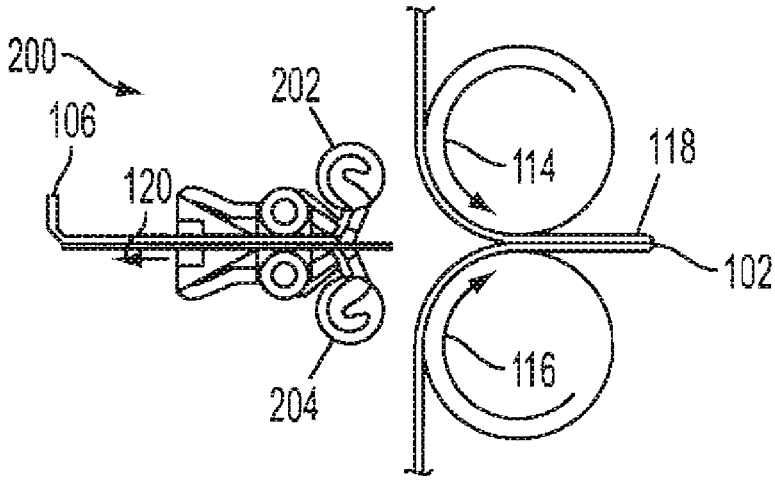
Figure 3A:
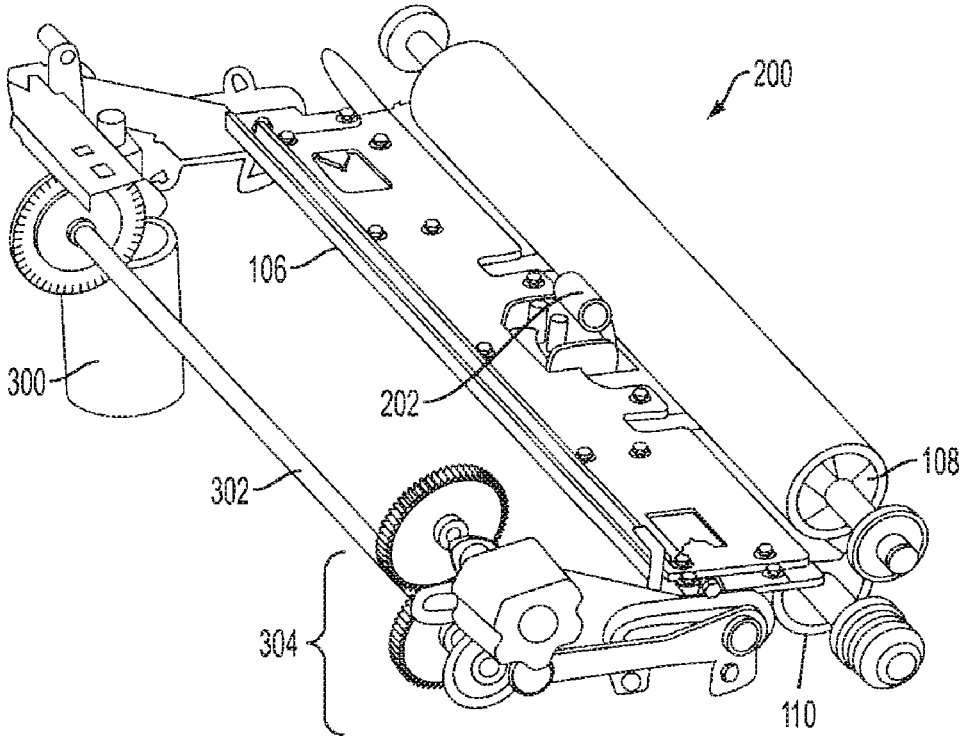
FIGS. 3A and 3B illustrate an exemplary embodiment of a crease blade and assist idler assembly.
Figure 3B:
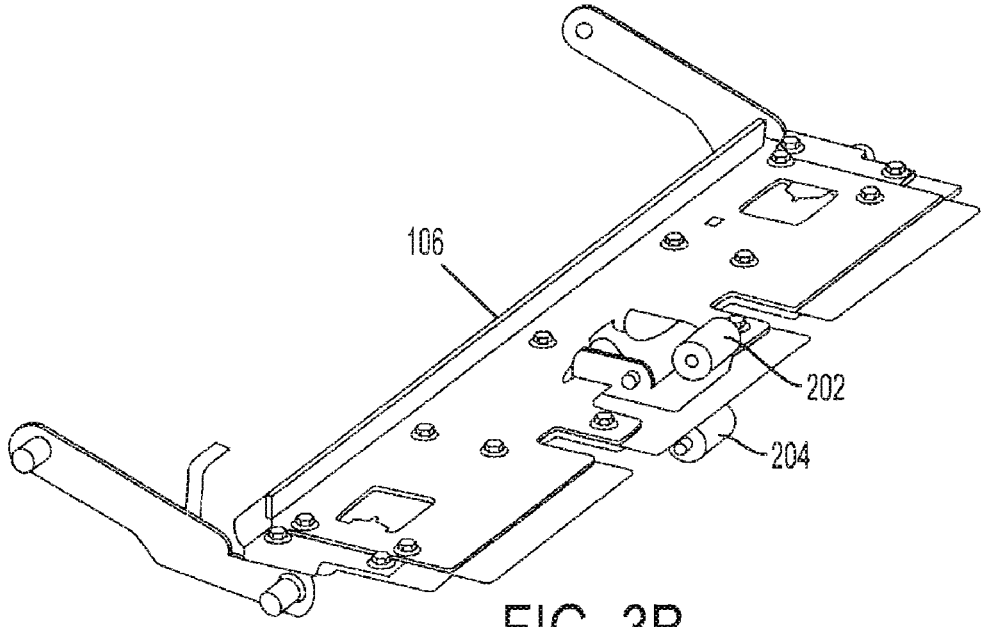

FIGS. 3A and 3B illustrate another exemplary embodiment of a crease blade and assist idler assembly 200. The assembly 200 in FIG. 3A includes a motor 300, a shaft 302 and a slider crank mechanism 304 in addition to the crease blade 106, the spring-loaded assist idler assembly 202, 204, the crease rolls 108, 110 and other elements. The slider crank mechanism 304 converts rotational motion from the motor 300 into translational motion (i.e., back and forth motion) to the blade 106. The slider crank mechanism 304 operates under the control of a controller (not shown) so that the motor drives the blade 106 forward (FIG. 2B) and then stops at a particular position (FIG. 2C). At this point, nip forces (indicated by arrows 206 and 208) are still being applied to the sheets 102 and the force remains until the sheets 102 enter the crease rolls 108, 110 (FIGS. 2C to 2D) and then the spring-loaded assist idler assembly 202, 204 backs off, retracts or drives back to the original position (FIG. 2D). FIG. 3B shows a portion of the assembly 200 of FIG. 3A isolating the crease blade 106 and the spring-loaded assist idler assembly 202, 204 so that both the upper assist idler 202 and the lower assist idler 204 are visible in FIG. 3B.

Figure 4A:
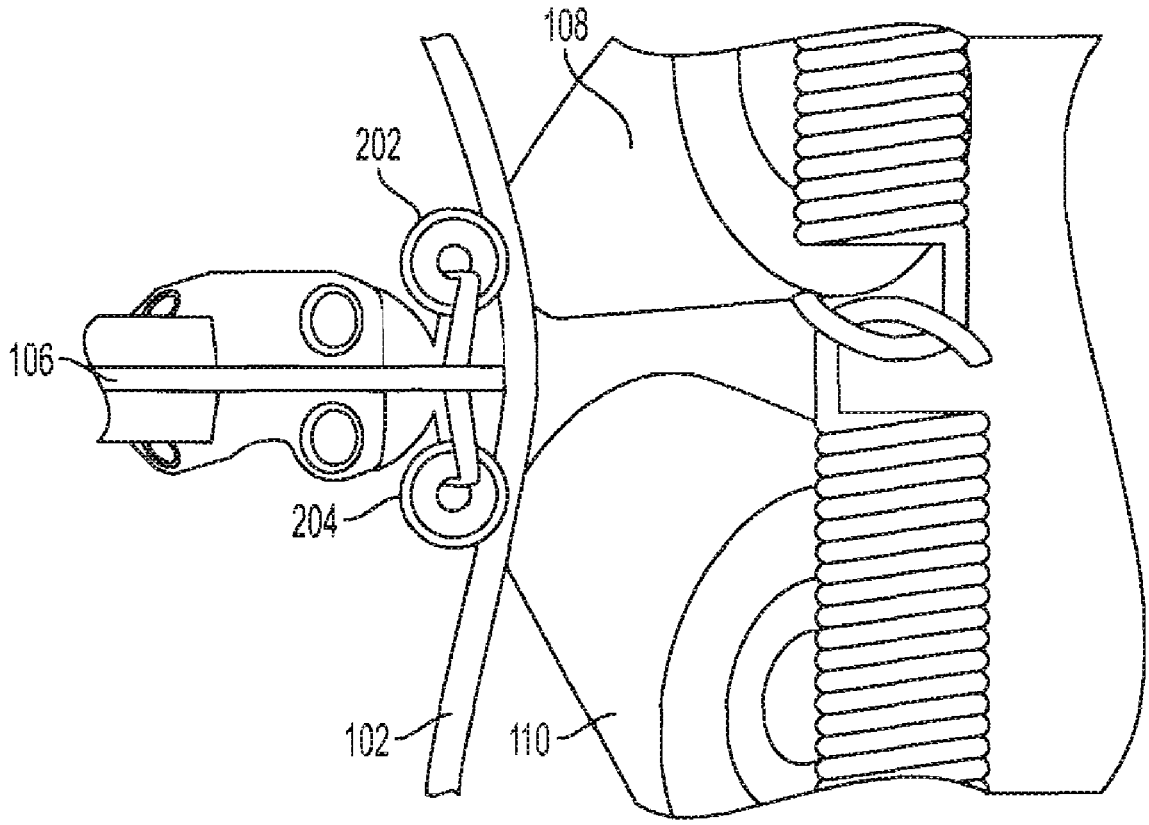
FIGS. 4A, 4B, 4C and 4D illustrate an exemplary bench test illustrating the difference between the operation of the subassembly in the related art of FIGS. 1A-1D and the exemplary embodiment of the subassembly of FIGS. 2A-2D.
Figure 4B:
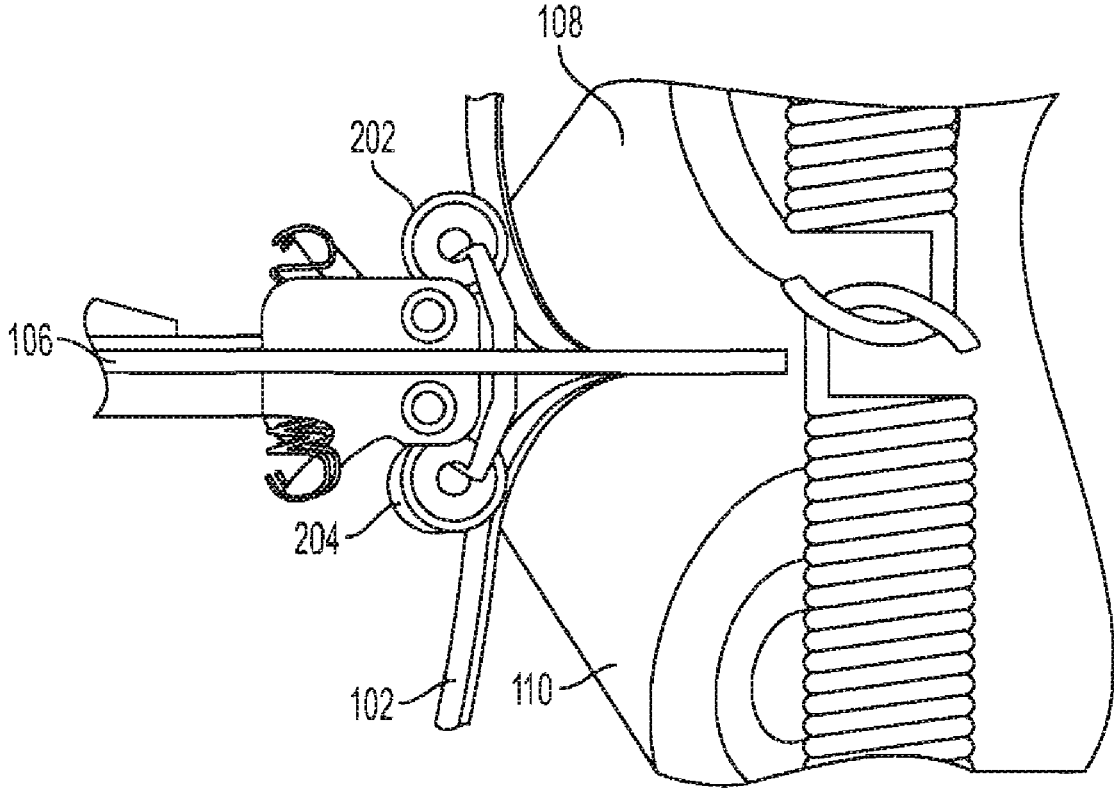
Figure 4C:
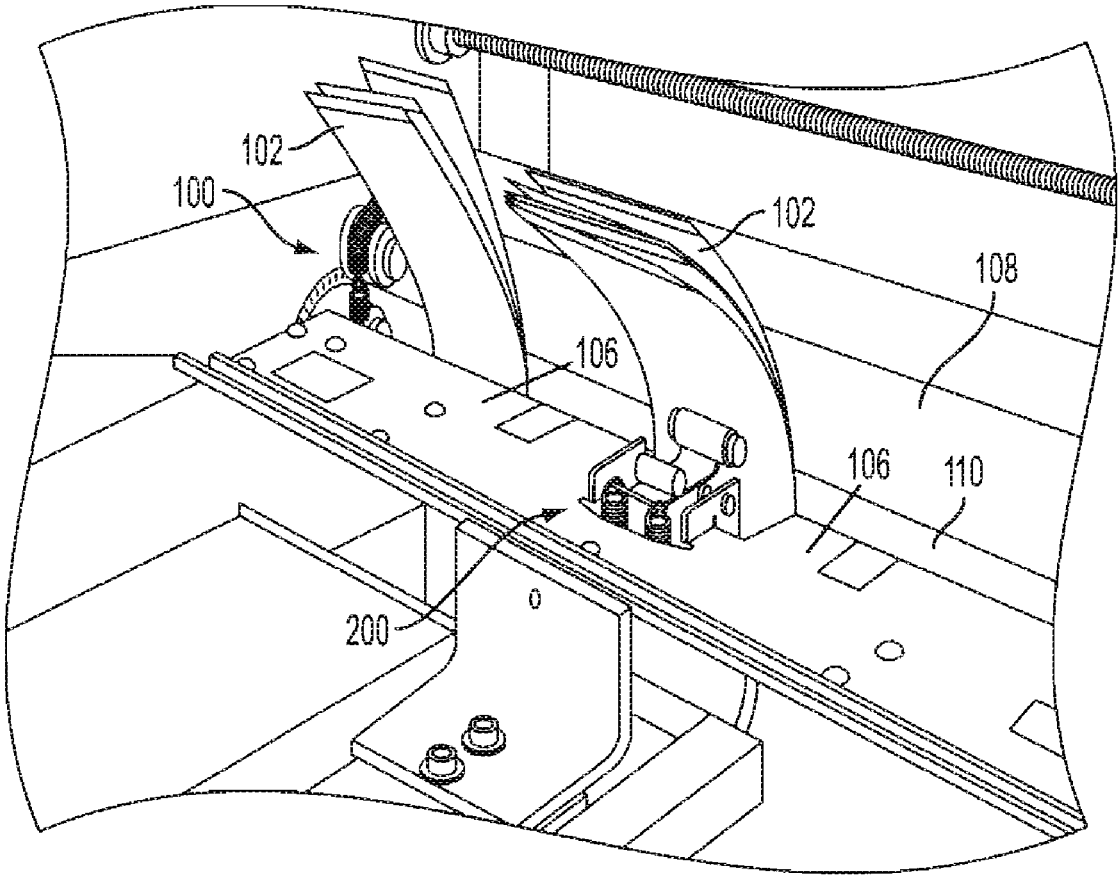
Figure 4D:
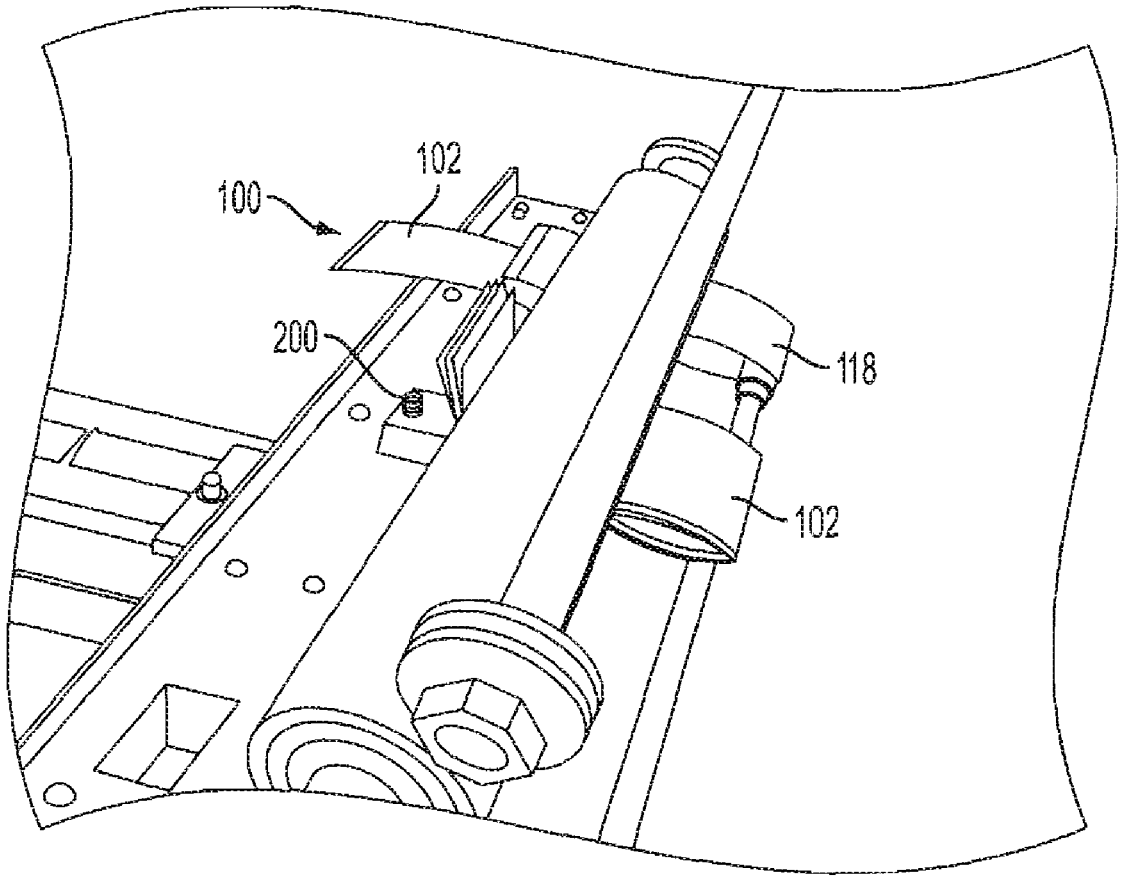

FIGS. 4A, 4B, 4C and 4D illustrate an exemplary bench test illustrating the difference between the operation of the subassembly 100 in the related art of FIGS. 1A-1D and the exemplary embodiment 200 of the subassembly of FIGS. 2A-2D. FIG. 4A shows the upper 202 and lower 204 spring-loaded idlers of subassembly 200 clamping the upper and lower halves of the stack of sheets 102 against the upper 108 and lower 110 crease rolls. FIG. 4B shows the sheets 102 being driven into the crease rolls 108, 110 to form a booklet. FIG. 4C shows the start of a test for both a subassemblv 100 for a booklet maker in the related art and an exemplary embodiment of a subassembly 200 for a booklet maker. In this test, the crease rolls 108, 110 were operated (i.e., turned) manually. This operation may also be performed with the assistance of the motor 300 or possibly an additional motor. One motor may drive the blade 106 and both crease rolls 108, 110 or one motor may drive the blade 106 while another motor drives the crease rolls 108, 110. FIG. 4D shows the test of FIG. 4C after the sheets 102 are folded into booklets for both the subassembly 100 in the related art and the exemplary embodiment of the subassembly 200. In FIG. 4D, the cover sheet 118 is pulled and/or torn from the stack of sheets 102 for the subassembly 100 in the related art, while the cover sheet is intact in the booklet made with the exemplary embodiment of the subassembly 200.

Figure 5:
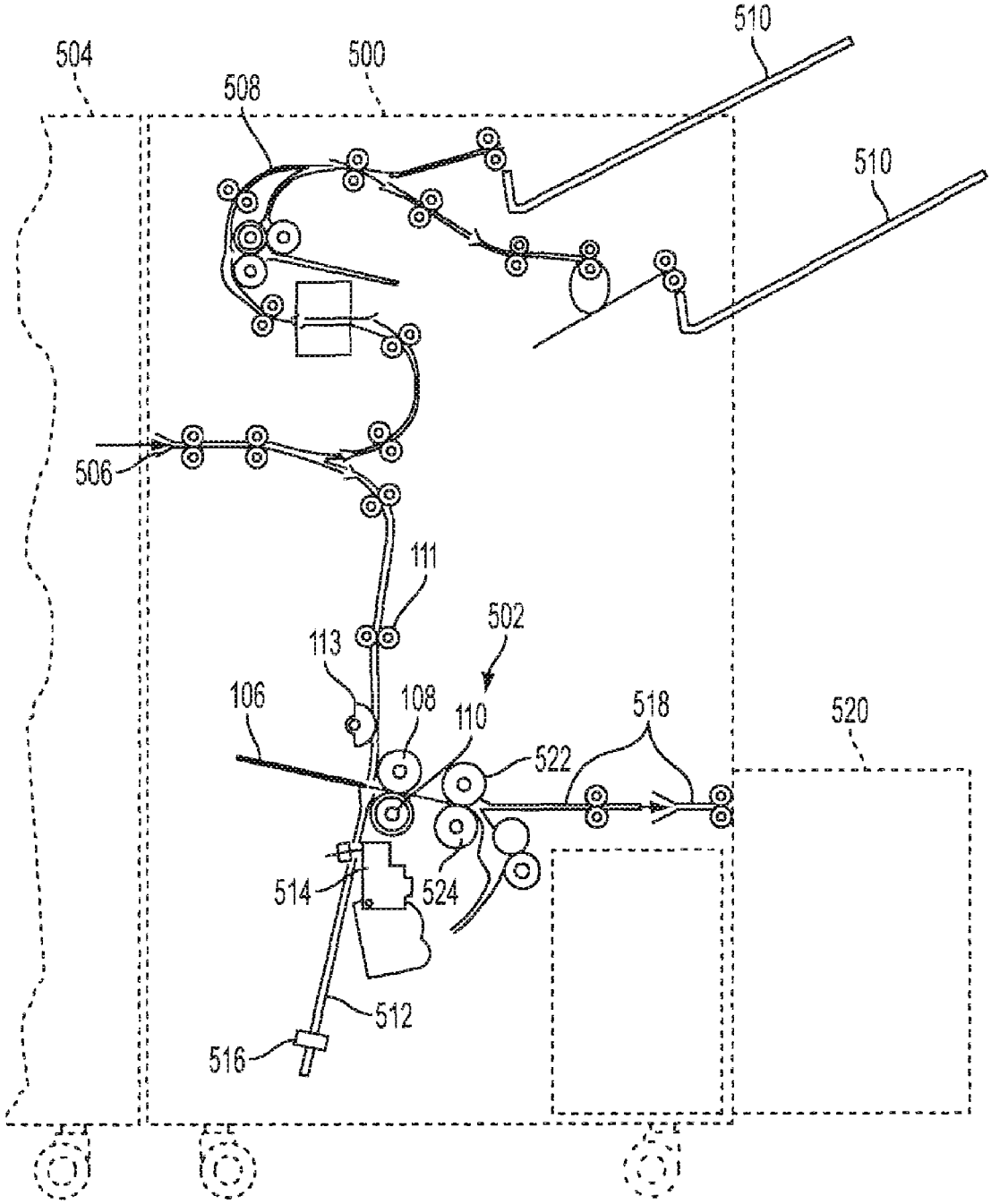
FIG. 5 illustrates a an exemplary finisher module.

FIG. 5 illustrates an exemplary embodiment of a finisher module 500, including a booklet maker 502, in a machine 504, such as a printer or copier for producing documents, booklets and other materials. The machine 504 provides printed sheets to an entry port 506 of the finisher module 500. The printed sheets may have multiple images for multiple pages and may be sheets of various media, such as signature sheets. Depending on the specific design of the finisher module 500, there may be numerous paths, such as 508 and numerous output trays 510 and 520, corresponding to one or more finishing functions, such as stapling, hole-punching and C- or Z-folding. The various rollers and other devices that contact and handle sheets within the finisher module 500 are driven by various motors, solenoids and other electromechanical devices (not shown), under a control system (not shown), within the finisher module 500, machine 504, or elsewhere, in a manner generally familiar in the art.

Booklet maker 502 defines a slot 512. The slot 512 accumulates signature sheets (e.g., sheets each having multiple page images thereon, for eventual folding into pages of a booklet) from the machine 504. Each sheet is held within the slot 512 at a level where stapler(s) 514 may staple the sheets along a midline. The midline of the sheets is the general location the eventual crease of the finished booklet. In order to hold sheets of a given size at the desired level relative to the stapler(s) 514, there is provided at the bottom of slot 512 an elevator 516, which forms the floor of the slot 512 on which the edges of the accumulating sheets rest before they are stapled. The elevator 516 is placed at different locations along the slot 512, depending on the size of the incoming sheets.

As printed signature sheets are output from the machine 504, they accumulate in the slot 512. When all of the necessary sheets to form a desired booklet are accumulated in the slot 512, the elevator 516 is moved from its first position to a second position where the midpoint of the sheets are adjacent the stapler(s) 514. The stapler(s) 514 is activated to place one or more staples along the midpoint of the sheets, where the booklet will eventually be folded.

After the stapling, the elevator 516 is moved from its second position to a third position, where the midpoint of the sheets are adjacent to the blade 106 and a nip formed by the crease rolls 108, 110. The action of the blade 106 and crease rolls 108, 110 performs the final folding, and sharp creasing, of the sheets into the finished booklet. The blade 106 contacts the sheet set along the stapled midpoint thereof, and bends the sheet set toward the nip of the first pair of crease rolls 108, 110 and the second pair of crease rolls 522, 524, which draw all the sheets in and form a crease. The creased and stapled sheet sets are then drawn, by the rotation of the crease rolls 108, 110, completely through the nip, to form the final main fold in the finished booklet. The finished booklets are then conducted along a path 518 and collected in a tray 520. One embodiment is a machine 504 including the finisher module 500 that includes the subassembly 200 (see FIG. 2) for the booklet maker 502.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A device for forming a fold in at least one sheet that extends along a first direction, the device comprising:

a blade that moves in a second direction that intersects the first direction to contact the at least one sheet at a first position;

a pair of rolls forming a nip, the nip being disposed along a path of the section of the at least one sheet that moves in the second direction; and at least one spring loaded assist idler roller assembly that contacts the at least one sheet at least at a second position, which is different from the first position, to move a section of the at least one sheet in the second direction;

wherein the spring loaded assist idler roller assembly includes: at least one spring loaded assist idler that provides a nip force on the at least one sheet by contacting the pair of rolls and translating perpendicular to the second direction.

2. The device of claim 1, wherein the fold in the at least one sheet is creased by the nip after the at least one sheet passes through the nip.

3. The device of claim 1, wherein the nip and a portion of the at least one sheet at the first position are both disposed along the path in the second direction.

4. The device of claim 1, further comprising:

a second movable member that contacts the at least one sheet at least at a third position, which is different from the first position and the second position, to move the section of the at least one sheet in the second direction.

5. The device of claim 4, wherein the blade and the second movable member move the at least one sheet by applying forces pressing the at least one sheet against the pair of rolls.

6. The device of claim 1, wherein contact of the blade with the at least one sheet creates a buckle in the at least one sheet.

7. A method for forming a fold in at least one sheet that extends along a first direction, the method comprising:

moving a blade in a second direction that intersects the first direction to contact the at least one sheet at a first position;

forming a nip with a pair of rolls along a path of the section of the at least one sheet movable in the second direction; and moving at least one spring loaded assist idler roller assembly to contact the at least at one sheet at least at a second position, which is different from the first position, to move a section of the at least one sheet in the second direction;

providing, with at least one spring loaded assist idler, of the spring loaded assist idler roller assembly, a nip force on the at least one sheet by contacting the pair of rolls and translating perpendicular to the second direction.

8. The method of claim 7, further comprising:

passing the at least one sheet through the nip; and creasing the fold in the at least one sheet as the at least one sheet passes through the nip.

9. The method of claim 7, wherein the nip and a portion of the at least one sheet at the first position are both disposed along the path in the second direction.

10. The method of claim 7, further comprising:

moving a second movable member to contact the at least one sheet at least at a third position, which is different from the first position and the second position, to move the section of the at least one sheet in the second direction.

11. The method of claim 10, further comprising:

rotating the pair of rolls; and moving the at least one sheet by the blade and the second movable member apply forces pressing the at least one sheet against the rotating pair of rolls.

12. The device of claim 1, further comprising:

a motor, and a slide crank mechanism that converts rotational motion of the motor into translational motion to the blade.

13. The method of claim 7, further comprising:

converting rotational motion of the motor into translational motion to the blade with a slide crank mechanism.

14. The method of claim 7, further comprising:

creating a buckle in the at least one sheet.

15. A system for forming a fold in at least one sheet that extends in a first direction, the system comprising:

means for contacting the at least one sheet at a first position by movement in a second direction that intersects the first direction;

means for moving a section of the at least one sheet in the second direction by contacting the at least one sheet at a second position, which is different from the first position;

means for forming a nip to provide a first nip force, the nip being disposed along a path of the section of the at least one sheet that moves in the second direction; and means for providing at least a second nip force on the at least one sheet by contacting the means for forming a nip and translating perpendicular to the second direction.

16. The system of claim 15, further comprising:

means for converting rotational motion of the motor system into translational motion to the means for contacting the at least one sheet at a first position by movement in a second direction that intersects the first direction.

* * * * *